US011674708B2

(12) United States Patent
Thobias et al.

(10) Patent No.: US 11,674,708 B2
(45) **Date of Patent: *Jun. 13, 2023**

(54) BLOWER WITH ADJUSTABLE CUTOFF PLATE

(71) Applicant: Lennox Industries Inc., Richardson, TX (US)

(72) Inventors: Patric Ananda Balan Thobias, Chennai (IN); Amit Parsai, Chennai (IN); Shiliang Wang, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/892,351

(22) Filed: Aug. 22, 2022

(65) Prior Publication Data

US 2022/0390139 A1 Dec. 8, 2022

Related U.S. Application Data

(63) Continuation of application No. 16/678,055, filed on Nov. 8, 2019, now Pat. No. 11,454,413.

(51) Int. Cl.

| | |
|---|---|
| ***F24F 11/72*** | (2018.01) |
| ***F04D 15/00*** | (2006.01) |
| ***F24F 11/46*** | (2018.01) |
| ***F24F 1/0022*** | (2019.01) |
| ***F04D 29/42*** | (2006.01) |
| ***F04D 29/46*** | (2006.01) |

(52) U.S. Cl.

CPC ..... *F24F 11/72* (2018.01); *F04D 15/0022* (2013.01); *F04D 29/422* (2013.01); *F04D 29/464* (2013.01); *F24F 1/0022* (2013.01); *F24F 11/46* (2018.01); *F04D 29/4226* (2013.01); *F05D 2260/57* (2013.01)

(58) Field of Classification Search

CPC ..... F24F 1/0022; F24F 11/46; F24F 11/72; F04D 15/0022; F04D 29/422

See application file for complete search history.

(56) References Cited

U.S. PATENT DOCUMENTS

| | | | |
|---|---|---|---|
| 2,801,042 | A | 7/1957 | Thygeson |
| 2,951,630 | A | 9/1960 | Murphy |
| 3,128,938 | A | 4/1964 | Ariewitz |
| 5,167,491 | A | 12/1992 | Keller, Jr. et al. |
| 5,772,399 | A | 6/1998 | Mehta et al. |
| 8,591,183 | B2 | 11/2013 | Lyons |
| 9,951,789 | B2 | 4/2018 | Sawyer |
| 2016/0208815 | A1 | 7/2016 | Sawyer |
| 2019/0323752 | A1 | 10/2019 | Fredslund et al. |

OTHER PUBLICATIONS

JP 2003042097 (English Translation) (Year: 2003).

*Primary Examiner* — Jonathan Bradford

(74) *Attorney, Agent, or Firm* — Bradley Arant Boult Cummings

(57) ABSTRACT

A blower for an HVAC system, the blower includes a housing with an intake and an outlet, a fan or blower wheel disposed within the housing and configured to draw air into the housing via the intake and to exhaust air from the housing through the outlet, and an adjustable cutoff plate configured to be moved between at least a first position defining a first cutoff angle and a second position defining a second cutoff angle.

20 Claims, 5 Drawing Sheets

BLOWER WITH ADJUSTABLE CUTOFF PLATE

CROSS-REFERENCE TO RELATED APPLICATIONS

This application is a continuation of U.S. patent application Ser. No. 16/678,055, filed on Nov. 8, 2019. U.S. patent application Ser. No. 16/678,055 is incorporated herein by reference.

TECHNICAL FIELD

The present invention relates generally to a heating, ventilation, and air conditioning (HVAC) system and more particularly, but not by way of limitation, to a system and method for improving the efficiency of a blower of the HVAC system.

BACKGROUND

HVAC systems include fans or blowers (e.g., blower wheels) that circulate air between the HVAC system and an enclosed space associated with the HVAC system. Some fans and blowers are designed to operate at different speeds so that conditioned air can be supplied to the enclosed space at different flow rates. For example, in multi-zone systems, less air flow is needed to supply one zone of the multi-zone system with conditioned air as compared to supplying conditioned air to two or more zones of the multi-zone system. The airflow from the fan or blower is varied by supplying the fan or blower with different amounts of power. For example, reducing the amount of power supplied to the fan or blower reduces the speed of the fan or blower and increasing the amount of power supplied to the fan or blower increases the speed of the fan or blower. While adjusting the amount of power supplied to the blower helps tailor the amount of airflow produced by the blower, increasing fan speed can result in operating conditions that are inefficient. Outlets of conventional fans or blowers are fixed in size. For a given outlet size, performance and efficiency of the fan or blower are maximized at particular operating conditions (e.g., power input to the blower, static pressure, etc.). Adding additional power to increase the speed of the fan or blower can result in compromised performance and efficiency.

BRIEF SUMMARY OF THE INVENTION

An illustrative blower for an HVAC system includes a housing with an intake and an outlet, a blower wheel or fan disposed within the housing and configured to draw air into the housing via the intake and to exhaust air from the housing through the outlet, and an adjustable cutoff plate configured to be moved between at least a first position defining a first cutoff angle and a second position defining a second cutoff angle.

An illustrate HVAC system includes an indoor unit with a blower that includes a housing with an intake and an outlet, a blower wheel or fan disposed within the housing and configured to draw air into the housing via the intake and to exhaust air from the housing through the outlet, and an adjustable cutoff plate configured to be moved between at least a first position defining a first cutoff angle and a second position defining a second cutoff angle. The indoor unit also includes a pressure sensor configured to measure a static pressure of air exiting the blower. The HVAC system also includes an HVAC controller configured to monitor the static pressure of the air exiting the blower and to control movement of the adjustable cutoff plate between the at least the first and second positions.

An illustrative method of improving efficiency of a blower in an HVAC system includes determining, by an HVAC controller of the HVAC system, if an enclosed space has a heating or cooling demand. Responsive to a determination by the HVAC controller that the enclosed space has a heating or cooling demand, instructing, by the HVAC controller, the HVAC system to power on to satisfy the heating or cooling demand. Determining, by the HVAC controller, if the cutoff angle of the blower should be adjusted. Responsive to a determination by the HVAC controller that the cutoff angle should be adjusted, adjusting a height of the adjustable cutoff plate to improve the efficiency of the blower.

DETAILED DESCRIPTION OF THE INVENTION

Embodiment(s) of the invention will now be described more fully with reference to the accompanying Drawings. The invention may, however, be embodied in many different forms and should not be construed as limited to the embodiment(s) set forth herein. The invention should only be considered limited by the claims as they now exist and the equivalents thereof.

Figure 1:
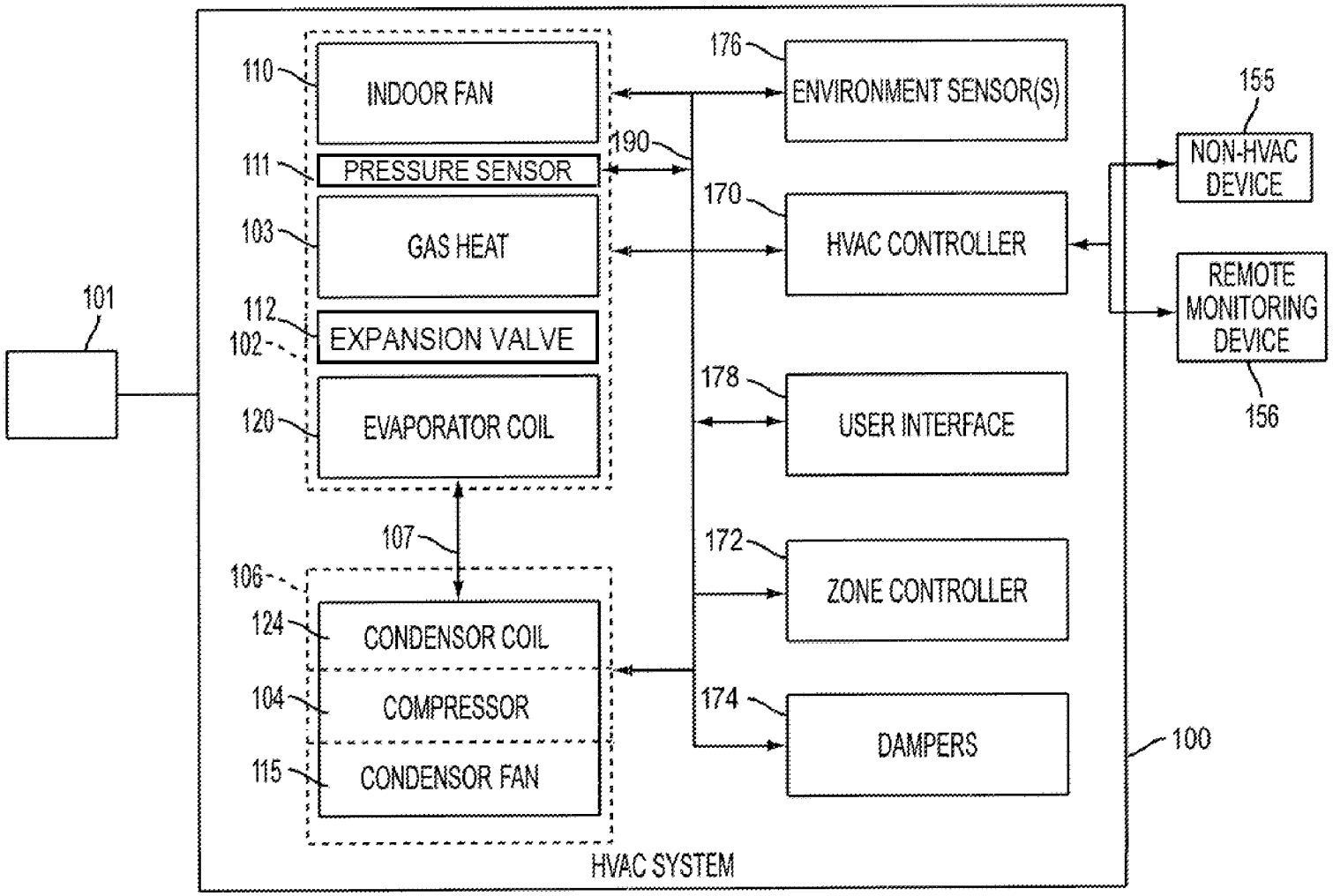
FIG. 1 is a block diagram of an illustrative HVAC system according to aspects of the disclosure.

FIG. 1 illustrates an HVAC system 100. HVAC system 100 is configured to condition air via, for example, heating, cooling, humidifying, or dehumidifying air within an enclosed space 101. In a typical embodiment, enclosed space 101 is, for example, a house, an office building, a warehouse, and the like. Thus, HVAC system 100 can be a residential system or a commercial system such as, for example, a rooftop system. HVAC system 100 includes various components; however, in other embodiments, HVAC system 100 may include additional components that are not illustrated but typically included within HVAC systems.

HVAC system 100 includes an indoor fan or blower 110, a gas heat 103 typically associated with blower 110, and an evaporator coil 120, also typically associated with blower 110. For the purposes of this disclosure, gas heat 103 is a single-stage gas furnace. HVAC system 100 includes an expansion valve 112. Expansion valve 112 may be a thermal expansion valve or an electronic expansion valve. Blower 110, gas heat 103, expansion valve 112, and evaporator coil 120 are collectively referred to as an indoor unit 102. In a typical embodiment, indoor unit 102 is located within, or in close proximity to, enclosed space 101. HVAC system 100 also includes a compressor 104, an associated condenser coil 124, and an associated condenser fan 115, which are collectively referred to as an outdoor unit 106. In various embodiments, outdoor unit 106 and indoor unit 102 are, for example, a rooftop unit or a ground-level unit. Compressor 104 and associated condenser coil 124 are connected to evaporator coil 120 by a refrigerant line 107. Refrigerant line 107 includes, for example, a plurality of copper pipes that connect condenser coil 124 and compressor 104 to evaporator coil 120. Compressor 104 may be, for example, a single-stage compressor, a multi-stage compressor, a single-speed compressor, or a variable-speed compressor. Blower 110 is configured to operate at different capacities (e.g., variable motor speeds) to circulate air through HVAC system 100, whereby the circulated air is conditioned and supplied to enclosed space 101. Blower 110 operates at different speeds depending on the demand. Blower 110 operates at lower speeds for lower demands and at higher speeds for higher demands. In some embodiments, indoor unit 102 includes a pressure sensor 111 that measures static pressure at an exit of blower 110. Pressure sensor 111 may be any of a variety of pressure sensor types, such as a pressure transmitter, magnetetic gauge, and the like. Static pressure describes the air resistance that blower 110 operates against. The static pressure is the result of numerous aspects of the HVAC system, such as, for example, the size and length of the ductwork in the system. HVAC system 100 includes an expansion valve 112. Expansion valve 112 may be a thermal expansion valve or an electronic expansion valve.

Still referring to FIG. 1, HVAC system 100 includes an HVAC controller 170 configured to control operation of the various components of HVAC system 100 such as, for example, blower 110, gas heat 103, and compressor 104 to regulate the environment of enclosed space 101. In some embodiments, HVAC system 100 can be a zoned system. HVAC system 100 includes a zone controller 172, dampers 174, and a plurality of environment sensors 176. In a typical embodiment, HVAC controller 170 cooperates with zone controller 172 and dampers 174 to regulate the environment of enclosed space 101.

HVAC controller 170 may be an integrated controller or a distributed controller that directs operation of HVAC system 100. HVAC controller 170 includes an interface to receive, for example, thermostat calls, temperature setpoints, blower control signals, environmental conditions, and operating mode status for various zones of HVAC system 100. The environmental conditions may include indoor temperature and relative humidity of enclosed space 101. In a typical embodiment, HVAC controller 170 also includes a processor and a memory to direct operation of HVAC system 100 including, for example, a speed of blower 110.

Still referring to FIG. 1, in some embodiments, the plurality of environment sensors 176 are associated with HVAC controller 170 and also optionally associated with a user interface 178. The plurality of environment sensors 176 provides environmental information within a zone or zones of enclosed space 101 such as, for example, temperature and/or humidity of enclosed space 101 to HVAC controller 170. The plurality of environment sensors 176 may also send the environmental information to a display of user interface 178. In some embodiments, user interface 178 provides additional functions such as, for example, operational, diagnostic, status message display, and a visual interface that allows at least one of an installer, a user, a support entity, and a service provider to perform actions with respect to HVAC system 100. In some embodiments, user interface 178 is, for example, a thermostat. In other embodiments, user interface 178 is associated with at least one sensor of the plurality of environment sensors 176 to determine the environmental condition information and communicate that information to the user. User interface 178 may also include a display, buttons, a microphone, a speaker, or other components to communicate with the user. Additionally, user interface 178 may include a processor and memory configured to receive user-determined parameters such as, for example, a relative humidity of enclosed space 101 and to calculate operational parameters of HVAC system 100 as disclosed herein.

HVAC system 100 is configured to communicate with a plurality of devices such as, for example, a monitoring device 156, a communication device 155, and the like. In a typical embodiment, and as shown in FIG. 1, monitoring device 156 is not part of HVAC system 100. For example, monitoring device 156 is a server or computer of a third party such as, for example, a manufacturer, a support entity, a service provider, and the like. In some embodiments, monitoring device 156 is located at an office of, for example, the manufacturer, the support entity, the service provider, and the like.

In a typical embodiment, communication device 155 is a non-HVAC device having a primary function that is not associated with HVAC systems. For example, non-HVAC devices include mobile-computing devices configured to interact with HVAC system 100 to monitor and modify at least some of the operating parameters of HVAC system 100. Mobile computing devices may be, for example, a personal computer (e.g., desktop or laptop), a tablet computer, a mobile device (e.g., smart phone), and the like. In a typical embodiment, communication device 155 includes at least one processor, memory, and a user interface such as a display. One skilled in the art will also understand that communication device 155 disclosed herein includes other components that are typically included in such devices including, for example, a power supply, a communications interface, and the like.

Zone controller 172 is configured to manage movement of conditioned air to designated zones of enclosed space 101. Each of the designated zones includes at least one conditioning or demand unit such as, for example, gas heat 103 and user interface 178, only one instance of user interface 178 being expressly shown in FIG. 1, such as, for example, the thermostat. HVAC system 100 allows the user to independently control the temperature in the designated zones. In a typical embodiment, zone controller 172 operates dampers 174 to control air flow to the zones of enclosed space 101.

A data bus 190, which in the illustrated embodiment is a serial bus, couples various components of HVAC system 100 together such that data is communicated therebetween. Data bus 190 may include, for example, any combination of hardware, software embedded in a computer readable medium, or encoded logic incorporated in hardware or otherwise stored (e.g., firmware) to couple components of HVAC system 100 to each other. As an example and not by way of limitation, data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local bus (VLB), or any other suitable bus or a combination of two or more of these. In various embodiments, data bus 190 may include any number, type, or configuration of data buses 190, where appropriate. In particular embodiments, one or more data buses 190 (which may each include an address bus and a data bus) may couple HVAC controller 170 to other components of HVAC system 100. In other embodiments, connections between various components of HVAC system 100 are wired. For example, conventional cable and contacts may be used to couple HVAC controller 170 to the various components. In some embodiments, a wireless connection is employed to provide at least some of the connections between components of HVAC system 100 such as, for example, a connection between HVAC controller 170 and blower 110 or the plurality of environment sensors 176.

Figure 2B:
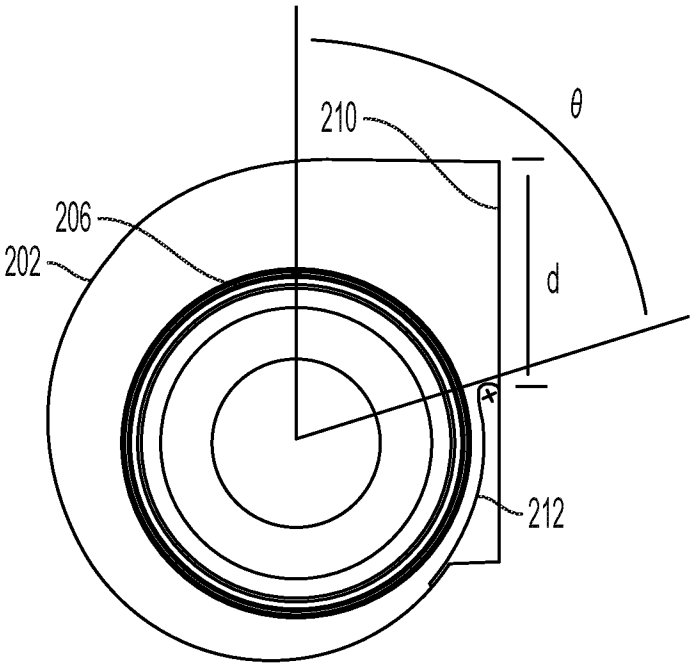
FIG. 2B PRIOR ART
FIGS. 2A and 2B illustrate a prior art blower.
Figure 2A:
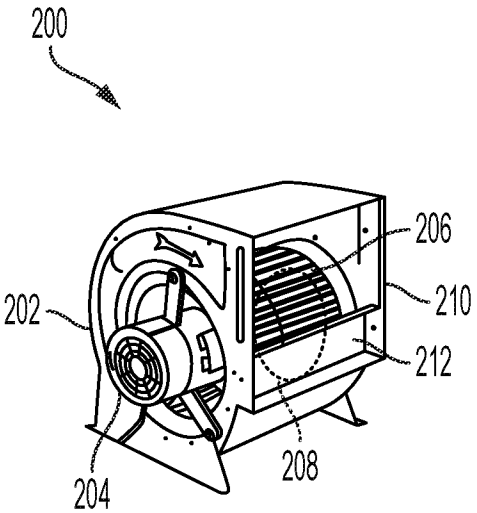
FIG. 2A PRIOR ART

FIGS. 2A and 2B illustrate a prior art blower 200. FIG. 2A is a perspective view of blower 200 and FIG. 2B is a side view of blower 200. Blower 200 is discussed relative to FIG. 1. Blower 200 may be incorporated into HVAC system 100 as blower 110 and includes a housing 202, a motor 204, and a blower wheel 206. Motor 204 drives blower wheel 206, which draws air in through an intake 208 and pushes air out through an outlet 210. Outlet 210 is coupled to, for example, gas heat 103 and evaporator coil 120. In other aspects, gas heat 103 and evaporator coil 120 may be coupled to inlet 208. Air from blower 200 circulates through gas heat 103 and evaporator coil 120 for heating and cooling, respectively, as needed and then circulates through enclosed space 101. Air from enclosed space 101 returns to indoor unit 102 via intake 208 of blower 200.

Outlet 210 includes a cutoff plate 212 that is fixed with respect to outlet 210. Cutoff plate 212 tunes the air flow behavior of blower 200. The position of cutoff plate 212 defines a distance d that dictates a size of a cutoff angle θ of outlet 210. As illustrated in FIG. 2B, the cutoff angle θ is the angle between a vertical line extending from a center point of blower wheel 206 and a line extending from the center point of blower wheel 206 to an edge of cutoff plate 212. As illustrated in FIGS. 2A and 2B, cutoff plate 212 is arranged for a cutoff angle of about 80°. For a given cutoff angle θ, blower 200 has a particular static pressure value that yields optimal blower performance. Static pressure describes the air resistance that blower 200 operates against. The static pressure is the result of numerous aspects of the HVAC system, such as, for example, the size and length of the ductwork in the system.

Figure 3A:
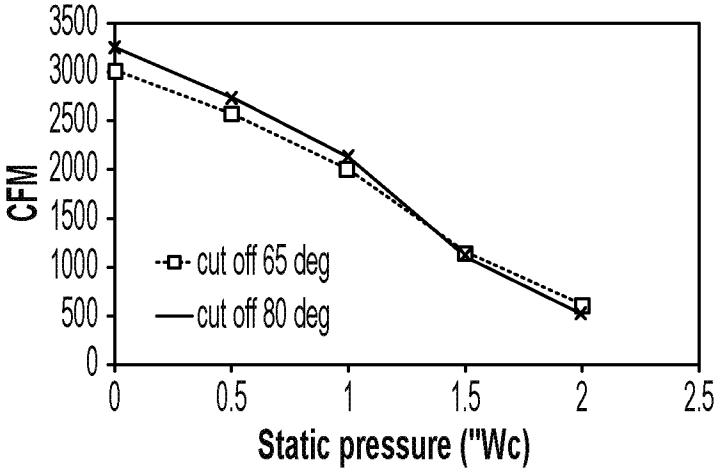
FIGS. 3A-3D are graphs illustrating performance of blowers at different cutoff angles according to aspects of the disclosure.

FIGS. 3A-3D are graphs illustrating performance of a blower at different cutoff angles θ. A conventional blower, such as blower 200, is manufactured with its cutoff plate in a fixed position to form a particular cutoff angle. FIGS. 3A-3D illustrate performance of blowers at various fixed cutoff angles. FIG. 3A illustrates a simulation of cubic feet per minute (CFM) versus static pressure (inches-water column) for blowers configured to operate at cutoff angles of 65° and 80°. FIG. 3A shows that for static pressures greater than about 1.3 inches-water column a cutoff angle of 80° yields less CFM than a cutoff angle of 65°. In other words, a cutoff angle of 65° is more efficient at static pressures greater than about 1.3 inches-water column.

Figure 3B:
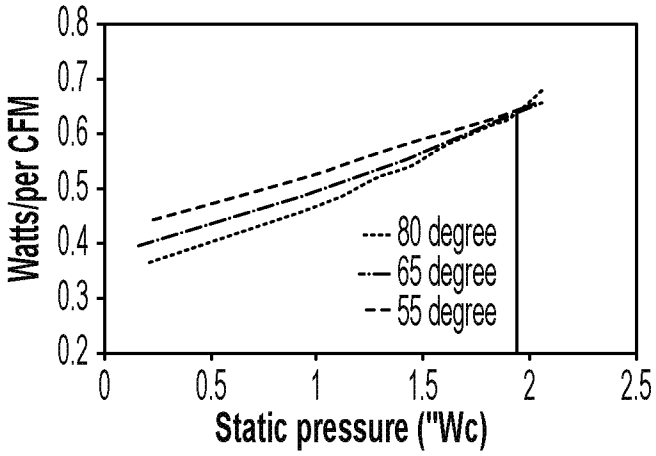

FIG. 3B illustrates test data of Watts/CFM of airflow versus static pressure (inches-water column) for blowers configured to operate at cutoff angles of 55°, 65°, and 80°. FIG. 3B shows that a cutoff angle of 80° provides better performance up to a static pressure of about 1.9 inches-water column, at which point cutoff angles of 55° and 65° provide better performance.

Figure 3C:
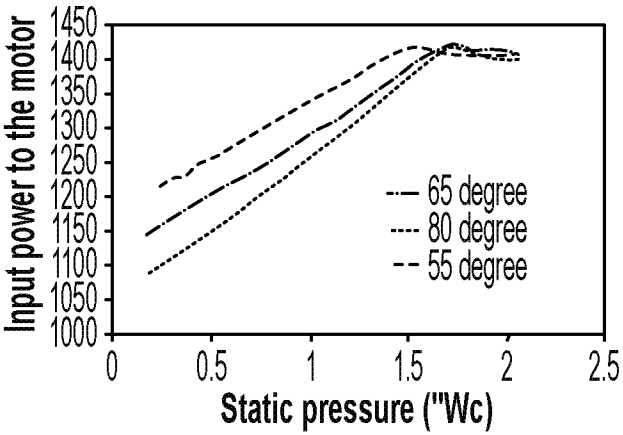

FIG. 3C illustrates test data of input power to a motor of the blower versus static pressure (inches-water column) for blowers configured to operate at cutoff angles of 55°, 65°, and 80°. FIG. 3C shows that the motor operates most efficiently at a cutoff angle of 80° until static pressure exceeds about 1.7 inches-water column, at which point cutoff angles of 55° and 65° provide better performance.

Figure 3D:
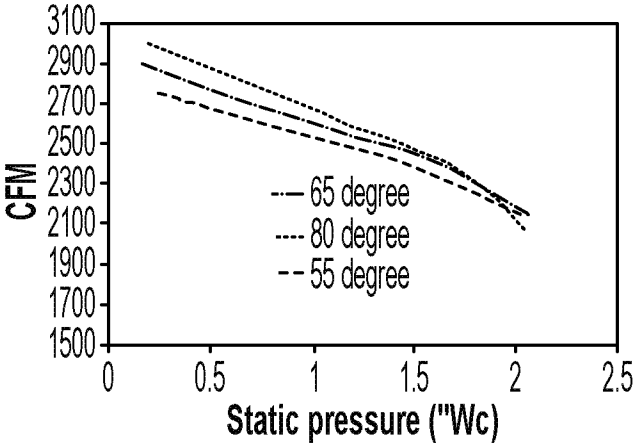

FIG. 3D illustrates test data of CFM versus static pressure (inches-water column) for blowers configured to operate at cutoff angles of 55°, 65°, and 80°. FIG. 3D shows that at a static pressure of around 1.7 inches-water column the performance at a cutoff angle of 80° begins to more rapidly drop and the performance at cutoff angles of 55° and 65° begins to overtake the 80° cutoff angle.

FIGS. 3A-3D illustrate that the performance of a blower varies for different cutoff angles and different static pressures. It can be seen in FIGS. 3A-3D that different cutoff angles are desirable for different operating conditions. For example, FIGS. 3A-3D illustrate that once static pressure passes a threshold value, blower performance can be improved by decreasing the cutoff angle. However, conventional blowers, such as blower 200, do not allow for the cutoff angle to be adjusted. As a result, a single cutoff angle is chosen for use under all operating conditions. Choosing a single cutoff angle results in situations where performance of the blower is compromised.

Figure 4B:
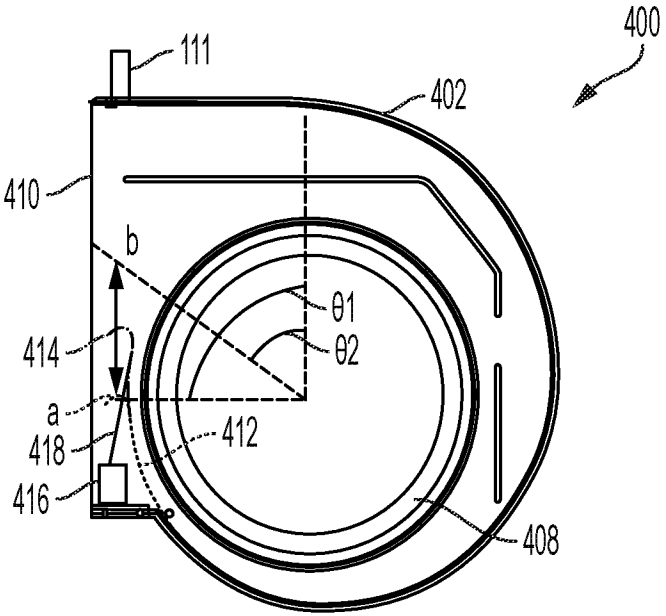
FIGS. 4A and 4B illustrate a blower with an adjustable cutoff plate according to aspects of the disclosure.
Figure 4A:
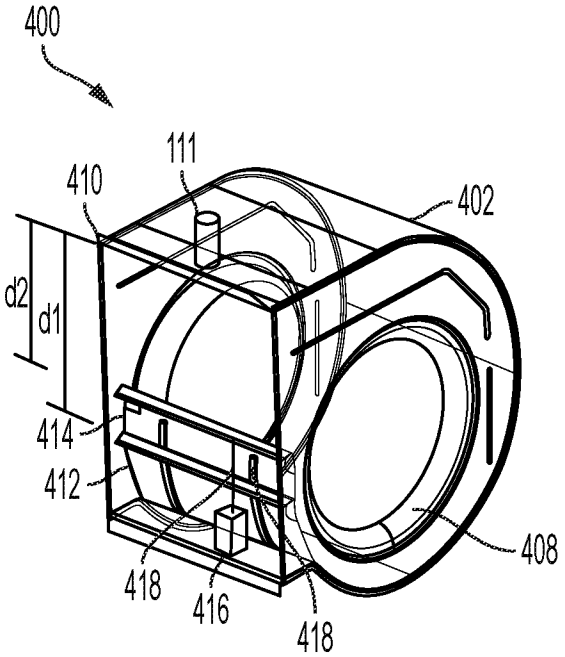

FIGS. 4A and 4B illustrate a blower 400 with an adjustable cutoff plate 414. Blower 400 is discussed relative to FIGS. 1, 2A-2B, and 3A-3D. Blower 400 may be incorporated into HVAC system 100 as blower 110. Blower 400 includes a housing 402 with an intake 408. Housing 402 is similar to housing 202 and is configured to house a fan or blower wheel and a motor, such as blower wheel 206 and motor 204. In the embodiment illustrated in FIGS. 4A and 4B, housing 402 includes a fixed cutoff plate 412 and adjustable cutoff plate 414. Fixed cutoff plate 412 is similar to cutoff plate 212 and is fixed with respect to housing 402. Fixed cutoff plate 412 is fixed at a distance d1 such that a large cutoff angle is formed (e.g., about 85°). Adjustable cutoff plate 414 is configured to move up and down between points a and b (see FIG. 4B) so that a distance d2 is variable. Changing distance d2 between points a and b changes a size of outlet 410 and a magnitude of cutoff angle θ of blower 400 between θ1 and θ2, respectively. For example, adjustable cutoff plate 414 can be lowered to point a to be adjacent to fixed cutoff plate 412 for a larger cutoff angle θ (e.g., about 85°) or raised to point b for a smaller cutoff angle θ (e.g., about 45°). Adjustable cutoff plate 414 can also be moved to any point between a and b to more finely tune cutoff angle θ.

Adjustable cutoff plate 414 may be moved in a variety of ways. For example, an actuator 416 can be coupled to adjustable cutoff plate 414 to move adjustable cutoff plate 414 between its various positions. Adjustable cutoff plate 414 may be moved to any position between its smallest and largest cutoff angles. The amount of adjustability of adjustable cutoff plate 414 is a design choice that depends upon the particular use case. By way of example, adjustable cutoff plate 414 is movable such that the cutoff angle may be varied between about 45° and 85°. In some aspects adjustable cutoff plate 414 is adjustable between about 60° and 85°. In some aspects, a cutoff angle of about 65°+/−3° is used for higher static pressure values and a cutoff angle of about 80°+/−3° is used for lower static pressure values. Actuator 416 can be an electric, pneumatic, or hydraulic actuator. A person of skill in the art will recognize that other methods may be used to move adjustable cutoff plate 414 (e.g., gears, linkages, etc.). In some embodiments actuator 416 is coupled to adjustable cutoff plate 414 via a linkage 418. For example, linkage 418 is coupled between actuator 416 and adjustable cutoff plate 414. Actuator 416 extends and retracts linkage 418 to move adjustable cutoff plate 414 between its lowest position with the largest cutoff angle and its highest position with the smallest cutoff angle. In some embodiments, adjustable cutoff plate 414 can be retrofitted to existing blowers, such as blower 200. In other embodiments, blower 400 may be constructed with only adjustable cutoff plate 414 (i.e., without fixed cutoff plate 412).

During operation of HVAC system 100, indoor unit 102 provides heated or cooled air to enclosed space 101 to satisfy a heating or cooling demand, respectively. Depending on the demand, blower 110 may operate at different speeds. As illustrated by FIGS. 3A-3D, blower performance can be optimized by using different cutoff angles for different static pressures. Static pressure at outlet 410 of blower 400 is measured via pressure sensor 111 that is secured to housing 402 proximal outlet 410. To improve the performance of HVAC system 100, blower 400 with adjustable cutoff plate 414 can be incorporated into HVAC system 100. Although FIGS. 4A-4B illustrate using a blower wheel specific to a forward curve design, those having skill in the art will recognize that the methods and concepts described herein similarly apply to other blower configurations, such as backward, radial, air foil blowers and other blower types which are available.

Figure 5:
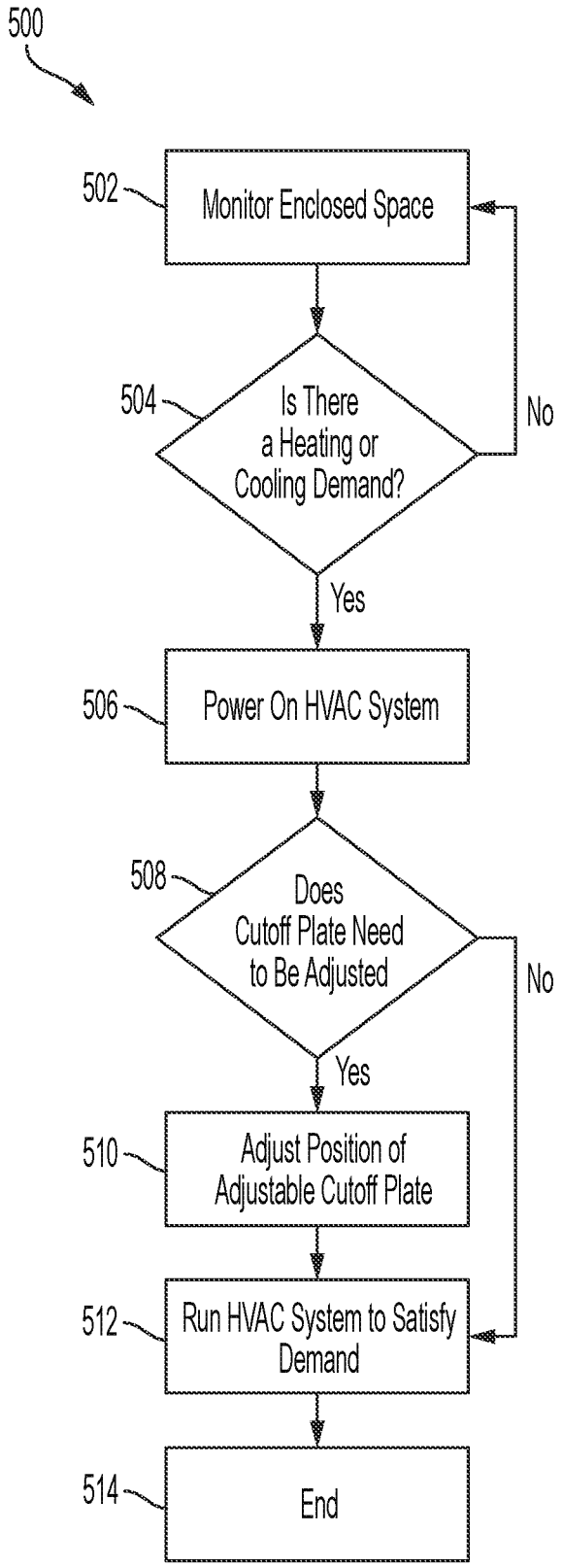
FIG. 5 illustrates a method of improving performance of a blower according to aspects of the disclosure.

FIG. 5 illustrates a method 500 of optimizing blower performance using blower 400. Method 500 is discussed relative to FIGS. 1, 2A-2B, 3A-3D, and 4A-4D. Method 500 begins at step 502. In step 502, HVAC controller 170 monitors enclosed space 101 to determine if enclosed space 101 has a heating or cooling demand. For example, HVAC controller 170 monitors user interface 178 (e.g., a thermostat) to check the temperature of enclosed space 101. Method 500 then proceeds to step 504. In step 504, HVAC controller 170 compares the temperature of enclosed space 101 to a heating or cooling threshold temperature (e.g., a temperature setpoint). Setpoint or temperature setpoint refers to a target temperature setting of HVAC system 100 as set by a user or automatically based on a pre-defined schedule. Responsive to a determination by HVAC controller 170 that enclosed space 101 has a heating or cooling demand, method 500 proceeds to step 506. Responsive to a determination by HVAC controller 170 that enclosed space 101 has no heating or cooling demand, method 500 returns to step 502 and HVAC controller 170 continues to monitor enclosed space 101 to determine if enclosed space 101 has a heating or cooling demand.

In step 506, HVAC controller 170 powers on HVAC system 100 to satisfy the heating or cooling demand from step 504. Method 500 then proceeds to step 508. In step 508, HVAC controller 170 determines if the cutoff angle of blower 400 should be adjusted to improve the performance of blower 400. For example, HVAC controller 170 may monitor the static pressure at the outlet of blower 400 via pressure sensor 111. If the static pressure exceeds a threshold value, HVAC controller 170 changes the cutoff angle of blower 400 by raising or lowering adjustable cutoff plate 414 to improve the performance of blower 400. Using FIG. 3A as an example, if adjustable cutoff plate 414 is configured for an 80° cutoff angle and the static pressure is above a threshold value of 1.4 inches-water column, performance of blower 400 can be improved by changing the cutoff angle of blower 400. The cutoff angle is changed by adjusting a height of adjustable cutoff plate 414.

In some aspects static pressure is not measured via pressure sensor 111. Instead HVAC controller 170 decides to change the cutoff angle based upon empirically determined data stored in a lookup table. For example, various parameters of blower 400 are known parameters of HVAC system 100 (e.g., fan speed, input power to motor, etc.). HVAC controller 170 can set the height of adjustable cutoff plate 414 based upon one or more of the known parameters. For example, HVAC controller 170 can compare a known parameter to a data value in the lookup table to determine if the cutoff angle should be changed. Responsive to a determination by HVAC controller 170 that the position of adjustable cutoff plate 414 should be changed, method 500 proceeds to step 510. Responsive to a determination by HVAC controller 170 that the position of adjustable cutoff plate 414 does not need to be changed, method 500 proceeds to step 512.

In step 510, HVAC controller 170 adjusts the position of adjustable cutoff plate 414. In some embodiments, the position of adjustable cutoff plate 414 is adjusted via actuator 416. Actuator 416 may be any type of actuator, such as, for example, an electric, pneumatic, or hydraulic actuator. A person of ordinary skill in the art will recognize that various actuators may be used to move adjustable cutoff plate 414. In various embodiments, the height of adjustable cutoff plate 414 may be adjustable between two or more discrete positions or between variable positions. Discrete positions may include a maximum height that creates a smallest cutoff angle and a minimum position that creates a largest cutoff angle. Additional discrete positions between the maximum and minimum heights may be included. Variable positioning of adjustable cutoff plate 414 allows adjustable cutoff plate 414 to be set at a height anywhere in between the maximum and minimum heights (e.g., anywhere between points a and b) to more finely tune the performance of blower 400. After step 510, method 500 proceeds to step 512.

In step 512, HVAC system 100 runs to satisfy the demand of enclosed space 101. Once the demand has been satisfied, HVAC system 100 shuts down. After step 512, method 500 ends at step 514. In some aspects, method 500 may return to step 502. A person of skill in the art will recognize that method 500 may be modified to include additional steps or to remove steps outlined above.

In this patent application, reference to encoded software may encompass one or more applications, bytecode, one or more computer programs, one or more executables, one or more instructions, logic, machine code, one or more scripts, or source code, and vice versa, where appropriate, that have been stored or encoded in a computer-readable storage medium. In particular embodiments, encoded software includes one or more application programming interfaces (APIs) stored or encoded in a computer-readable storage medium. Particular embodiments may use any suitable encoded software written or otherwise expressed in any suitable programming language or combination of programming languages stored or encoded in any suitable type or number of computer-readable storage media. In particular embodiments, encoded software may be expressed as source code or object code. In particular embodiments, encoded software is expressed in a higher-level programming language, such as, for example, C, Python, Java, or a suitable extension thereof. In particular embodiments, encoded software is expressed in a lower-level programming language, such as assembly language (or machine code). In particular embodiments, encoded software is expressed in JAVA. In particular embodiments, encoded software is expressed in Hyper Text Markup Language (HTML), Extensible Markup Language (XML), or other suitable markup language.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A blower for an HVAC system, the blower comprising:
a housing comprising an intake and an outlet;
a blower wheel disposed within the housing and configured to draw air into the housing via the intake and to exhaust air from the housing through the outlet;
a first cutoff plate;
a second cutoff plate that is adjustable;
an HVAC controller configured to determine whether a static pressure of air exiting the blower exceeds a threshold value and the adjustable cutoff plate is configured for an 80° cutoff angle; and
responsive to the determination that the static pressure of air exiting the blower exceeds the threshold value and the adjustable cutoff plate is configured for the 80° cutoff angle, the HVAC controller moves the second cutoff plate between a first position and a second position to change the 80° cutoff angle.

2. The blower of claim 1, wherein the first cutoff plate is fixed with respect to the housing.

3. The blower of claim 1, wherein the second cutoff plate is configured to be moved between at least the first position defining a first cutoff angle and the second position defining a second cutoff angle.

4. The blower of claim 1, wherein the threshold value comprises 1.4 inches-water column.

5. The blower of claim 1, comprising an actuator coupled to the second cutoff plate and configured to move the second cutoff plate between the first and second positions.

6. The blower of claim 5, wherein the actuator is coupled to the second cutoff plate via a linkage that is secured to the second cutoff plate.

7. The blower of claim 5, wherein the actuator is configured to move the second cutoff plate between at least the first position, the second position, and a third position.

8. The blower of claim 1, comprising a pressure sensor configured to measure the static pressure of air exiting the blower.

9. The blower of claim 8, wherein the pressure sensor is coupled to the housing proximal the outlet.

10. An HVAC system comprising:
an indoor unit comprising:
a blower comprising:
a housing with an intake and an outlet;
a blower wheel disposed within the housing and configured to draw air into the housing via the intake and to exhaust air from the housing through the outlet;
a first cutoff plate;
a second cutoff plate that is adjustable;
an HVAC controller configured to monitor a static pressure of the air exiting the blower and determine whether the static pressure of air exiting the blower exceeds a threshold value and the second cutoff plate is configured for an 80° cutoff angle; and
responsive to the determination that the static pressure of air exiting the blower exceeds the threshold value and the second cutoff plate is configured for the 80° cutoff angle, the HVAC controller moves the second cutoff plate between a first position and a second position to change the 80° cutoff angle.

11. The HVAC system of claim 10, wherein the first cutoff plate is fixed with respect to the housing.

12. The HVAC system of claim 10, wherein the second cutoff plate is configured to be moved between at least the first position defining a first cutoff angle and the second position defining a second cutoff angle.

13. The HVAC system of claim 10, wherein the threshold value comprises 1.4 inches-water column.

14. The HVAC system of claim 10, comprising an actuator coupled to the second cutoff plate and configured to move the second cutoff plate between the first and second positions.

15. The HVAC system of claim 14, wherein the actuator is coupled to the second cutoff plate via a linkage that is secured to the second cutoff plate.

16. The HVAC system of claim 14, wherein the actuator is configured to move the second cutoff plate between at least the first position, the second position, and a third position.

17. The HVAC system of claim 10, comprising a pressure sensor configured to measure the static pressure of air exiting the blower.

18. The HVAC system of claim 17, wherein the pressure sensor is coupled to the housing proximal the outlet.

19. A method of improving efficiency of a blower in an HVAC system, the method comprising:
determining, by an HVAC controller, if an enclosed space has a heating or cooling demand;
responsive to the determination by the HVAC controller that the enclosed space has a heating or cooling demand, instructing, by the HVAC controller, the HVAC system to power on to satisfy the heating or cooling demand;

determining, by the HVAC controller, that a static pressure of air exiting the blower exceeds a threshold value and a second cutoff plate is configured for an 80° cutoff angle; and responsive to the determination that the static pressure of air exiting the blower exceeds the threshold value and the second cutoff plate is configured for the 80° cutoff angle, adjusting, relative to a first cutoff plate, a height of the second cutoff plate to change the 80° cutoff angle to improve the efficiency of the blower.

20. The method of claim 19, wherein:

the first cutoff plate is fixed with respect to a housing; and the second cutoff plate is configured to be moved between at least a position defining a first cutoff angle and a second position defining a second cutoff angle.

* * * * *